US010468174B2

(12) United States Patent
Mihara et al.

(10) Patent No.: US 10,468,174 B2
(45) Date of Patent: Nov. 5, 2019

(54) MAGNETIC CORE AND COIL COMPONENT

(71) Applicant: HITACHI METALS, LTD., Tokyo (JP)

(72) Inventors: Toshio Mihara, Minato-ku (JP); Tetsuroh Katoh, Minato-ku (JP); Kazunori Nishimura, Minato-ku (JP); Shin Noguchi, Minato-ku (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/333,132

(22) PCT Filed: Sep. 15, 2017

(86) PCT No.: PCT/JP2017/033423

§ 371 (c)(1),
(2) Date: Mar. 13, 2019

(87) PCT Pub. No.: WO2018/052108

PCT Pub. Date: Mar. 22, 2018

(65) Prior Publication Data

US 2019/0228897 A1 Jul. 25, 2019

(30) Foreign Application Priority Data

Sep. 15, 2016 (JP) ..... 2016-180264

(51) Int. Cl.
*H01F 27/28* (2006.01)
*H01F 27/255* (2006.01)
(Continued)

(52) U.S. Cl.
CPC ..... *H01F 27/255* (2013.01); *B22F 1/00* (2013.01); *C22C 38/00* (2013.01); *H01F 1/147* (2013.01);
(Continued)

(58) Field of Classification Search
CPC ..... H01F 27/00–36
(Continued)

(56) References Cited

U.S. PATENT DOCUMENTS 2,873,225 A * 2/1959 Adams ..... H01F 1/14791 148/105
2005/0007232 A1* 1/2005 Ono ..... H01F 1/1475 336/213
(Continued)

FOREIGN PATENT DOCUMENTS

JP 57-60024 A 4/1982
JP 06-293943 A 10/1994
(Continued)

OTHER PUBLICATIONS

International Preliminary Report on Patentability with translation of Written Opinion for International Application No. PCT/JP2017/033423 dated Mar. 19, 2019; 8 pages.
(Continued)

*Primary Examiner* — Tuyen T Nguyen
(74) *Attorney, Agent, or Firm* — Sughrue Mion, PLLC

(57) ABSTRACT

Provided are a magnetic core having a high initial permeability and a coil component including the same. The magnetic core has an X-ray diffraction spectrum of the magnetic core measured using Cu-Kα characteristic X-rays, wherein a peak intensity ratio (P1/P2) of a peak intensity P1 of a diffraction peak of an Fe oxide having a corundum structure appearing in a vicinity of 2θ=33.2° to a peak intensity P2 of a diffraction peak of the Fe-based alloy having a bcc structure appearing in a vicinity of 2θ=44.7° is 0.015 or less; and in the X-ray diffraction spectrum, a peak intensity ratio (P3/P2) of a peak intensity P3 of a superlattice
(Continued)

peak of an $Fe_3Al$ ordered structure appearing in a vicinity of $2\theta=26.6°$ to the peak intensity P2 is 0.015 or more and 0.050 or less.

4 Claims, 6 Drawing Sheets

(51) Int. Cl.

| | |
|---|---|
| ***B22F 1/00*** | (2006.01) |
| ***C22C 38/00*** | (2006.01) |
| ***H01F 1/147*** | (2006.01) |
| ***H01F 1/24*** | (2006.01) |
| ***H01F 1/33*** | (2006.01) |
| ***H01F 17/04*** | (2006.01) |

(52) U.S. Cl.
CPC ..... *H01F 1/14791* (2013.01); *H01F 1/24* (2013.01); *H01F 1/33* (2013.01); *H01F 17/04* (2013.01); *H01F 27/28* (2013.01)

(58) Field of Classification Search
USPC ..... 336/65, 83, 212, 225, 229, 233–234
See application file for complete search history.

(56) References Cited

U.S. PATENT DOCUMENTS

| | | | | |
|---|---|---|---|---|
| 2015/0332850 | A1 | 11/2015 | Nishio et al. | |
| 2016/0336104 | A1 | 11/2016 | Noguchi et al. | |
| 2017/0178775 | A1* | 6/2017 | Noguchi | B22F 5/00 |
| 2017/0207017 | A1* | 7/2017 | Noguchi | H01F 1/20 |

FOREIGN PATENT DOCUMENTS

| | | | |
|---|---|---|---|
| JP | 2000-100614 | A | 4/2000 |
| JP | 2009-060050 | A | 3/2009 |
| WO | 2014/112483 | A1 | 7/2014 |
| WO | 2015/108059 | A1 | 7/2015 |

OTHER PUBLICATIONS

International Search Report of PCT/JP2017/033423 dated Dec. 12, 2017.

* cited by examiner

IRON Kα1

ALUMINUM Kα1

CHROMIUM Ka1

SILICON Ka1

OXYGEN Ka1

MAGNETIC CORE AND COIL COMPONENT

CROSS REFERENCE TO RELATED APPLICATIONS

This application is a National Stage of International Application No. PCT/JP2017/033423 filed Sep. 15, 2017, claiming priority based on Japanese Patent Application No. 2016-180264 filed Sep. 15, 2016.

TECHNICAL FIELD

The present invention relates to a magnetic core containing Fe-based alloy particles containing Al and a coil component including the same.

BACKGROUND ART

Conventionally, coil components such as inductors, transformers, chokes, and motors are used in a wide variety of applications such as home electric appliances, industrial apparatuses, and vehicles. A common coil component includes a magnetic core and a coil wound around the magnetic core in many cases. For such a magnetic core, ferrite is widely used, which is excellent in magnetic properties, a degree of freedom of a shape, and cost merits.

In recent years, as a result of downsizing of power supplies for electronic devices or the like, there has been a strong demand for compact low-profile coil components which can be used even with a large current. Magnetic cores containing a metal-based magnetic powder which has a saturation magnetic flux density higher than that of ferrite are increasingly used.

As the metal-based magnetic powder, Fe—Si-based, Fe—Ni-based, Fe—Si—Cr-based, and Fe—Si—Al-based magnetic alloy powders are used, for example. A magnetic core obtained by consolidating a green compact of the magnetic alloy powder has a high saturation magnetic flux density. But, the magnetic core has low electric resistivity because of the alloy powder. The magnetic alloy powder is previously insulation-coated with water glass or a thermosetting resin or the like in many cases.

Meanwhile, the following technique has also been proposed (see Patent Document 1). Soft magnetic alloy particles containing Al and Cr together with Fe are molded, and then heat-treated in an oxygen-containing atmosphere to form an oxide layer obtained by the oxidation of the alloy particles on the surface of the particles. The soft magnetic alloy particles are bonded via the oxide layer, and insulation properties are imparted to a magnetic core.

PRIOR ART DOCUMENTS

Patent Document

Patent Document 1: International Publication No. 2014/112483

SUMMARY OF THE INVENTION

Problems to be Solved by the Invention

In the meantime, a magnetic core used for a coil component is required to have a high initial permeability. In general, a high initial permeability tends to be provided by increasing the density of a green compact to decrease a void between particles, or by increasing the temperature of a heat treatment to increase the space factor of a magnetic core. However, when a metal-based magnetic powder is formed by consolidation, molding at a high-pressure may cause the breakage of a mold and restrict the shape of a magnetic core. When a heat treatment temperature is increased, the sintering of the metal-based magnetic powder may proceed, whereby insulation properties are not obtained.

The present invention has been made in view of the above problems, and it is an object of the present invention to provide a magnetic core which has a high initial permeability; and a coil component including the same.

Means for Solving the Problems

A first aspect of the invention is a magnetic core containing Fe-based alloy particles containing Al, wherein: the Fe-based alloy particles are bound via an oxide derived from an Fe-based alloy; in an X-ray diffraction spectrum of the magnetic core measured using Cu-Kα characteristic X-rays, a peak intensity ratio (P1/P2) of a peak intensity P1 of a diffraction peak of an Fe oxide having a corundum structure appearing in the vicinity of $2\theta=33.2°$ to a peak intensity P2 of a diffraction peak of the Fe-based alloy having a bcc structure appearing in the vicinity of $2\theta=44.7°$ is 0.015 or less; and in the X-ray diffraction spectrum, a peak intensity ratio (P3/P2) of a peak intensity P3 of a superlattice peak of an $Fe_3Al$ ordered structure appearing in the vicinity of $2\theta=26.60$ to the peak intensity P2 is 0.015 or more and 0.050 or less.

In the present invention, the magnetic core preferably has an initial permeability μi of 55 or more.

In the present invention, it is preferable that the Fe-based alloy is represented by a composition formula: aFebAlcCrdSi, and in mass %, $a+b+c+d=100$, $13.8\leq b\leq 16$, $0\leq c\leq 7$, and $0\leq d\leq 1$ are satisfied.

A second aspect of the invention is a coil component including the magnetic core according to the first aspect of the invention and a coil.

Effect of the Invention

The present invention can provide a magnetic core containing Fe-based alloy particles containing Al having a high initial permeability, and a coil component including the same.

MODE FOR CARRYING OUT THE INVENTION

Figure 1A:
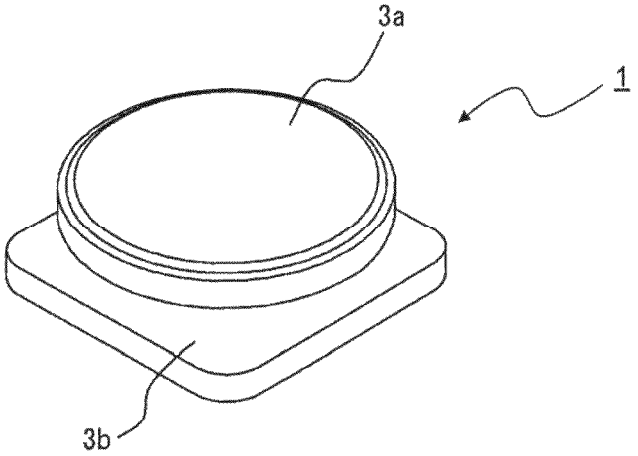
FIG. 1A is a perspective view schematically showing a magnetic core according to an embodiment of the present invention.

Hereinafter, a magnetic core according to an embodiment of the present invention and a coil component including the same will be specifically described. However, the present invention is not limited thereto. Note that components unnecessary for the description are omitted from some or all of the drawings and that some components are illustrated, in an enlarged or reduced manner to facilitate the description. A size, a shape, and a relative positional relationship between constituent members, or the like shown in the description are not limited only to those in the description unless otherwise specified. Furthermore, in the description, the same names and reference numerals designate the same or the identical members, and even if the members are illustrated, the detailed description may be omitted.

Figure 1B:
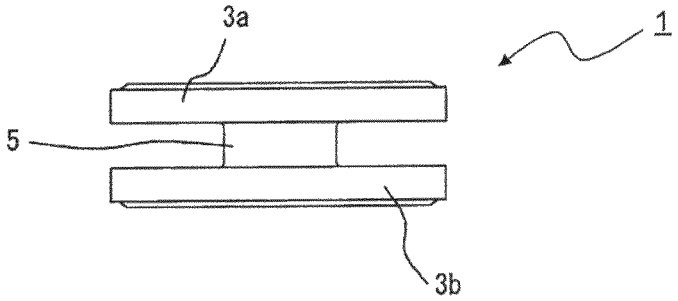
FIG. 1B is a front view schematically showing a magnetic core according to an embodiment of the present invention.

FIG. 1A is a perspective view schematically showing a magnetic core of the present embodiment, and FIG. 1B is a front view thereof. A magnetic core 1 includes a cylindrical conductive wire winding portion 5 for winding a coil and a pair of flange portions 3*a* and 3*b* disposed opposite to both end portions of the conductive wire winding portion 5. The magnetic core 1 has a drum type appearance. The cross-sectional shape of the conductive wire winding portion 5 is not limited to a circular shape, and any shape such as a square shape, a rectangular shape, or an elliptical shape may be employed. The flange portion may be disposed on each of both the end portions of the conductive wire winding portion 5, or may be disposed on only one end portion. Note that the illustrated shape examples show one form of the magnetic core configuration, and the effects of the present invention are not limited to the illustrated configuration.

The magnetic core according to the present invention is formed by a heat treated product of Fe-based alloy particles, and is configured as an aggregate in which a plurality of Fe-based alloy particles containing Al are bonded via an oxide layer containing an Fe oxide. Furthermore, the magnetic core according to the present invention has $Fe_3Al$ which is a compound of Fe and Al. The Fe oxide is an oxide formed through the heat treatment of an Fe-based alloy and derived from the Fe-based alloy, and is present at a grain boundary between the Fe-based alloy particles and on the surface of the magnetic core and also functions as an insulating layer which separates the particles. The Fe oxide is confirmed by the diffraction peak of an Fe oxide having a corundum structure appearing in the vicinity of $2\theta=33.2°$ in an X-ray diffraction spectrum obtained by measuring the surface of the magnetic core using Cu-K$\alpha$ characteristic X-rays to be described below.

The compound having an $Fe_3Al$ ordered structure is also a compound formed through the heat treatment of the Fe-based alloy, and is confirmed by the superlattice peak of the $Fe_3Al$ ordered structure appearing in the vicinity of $2\theta=26.6°$ in the X-ray diffraction spectrum.

In the present invention, the oxide of Fe formed from the Fe-based alloy is regulated to have a peak intensity ratio (P1/P2) of 0.015 or less. The compound derived from $Fe_3Al$ is regulated to have a peak intensity ratio (P3/P2) of 0.015 or more and 0.050 or less. In the present invention, by defining each of the peak intensity ratios (P1/P2, P3/P2), the initial permeability can be increased.

The peak intensity ratio (P1/P2) of the X-ray diffraction is obtained by analyzing the magnetic core according to the X-ray diffraction method (XRD), and measuring the peak intensity P1 of the Fe oxide (104 plane) and the diffraction peak intensity P2 derived from the Fe-based alloy (110 plane) having a bcc structure appearing in the vicinity of $2\theta=44.7°$ as the diffraction maximum intensity in the X-ray diffraction spectrum. The peak intensity ratio (P3/P2) of the X-ray diffraction can be obtained by measuring the peak intensity P3 of the compound (111 plane) having the $Fe_3Al$ ordered structure. A diffraction intensity is smoothed for a diffraction angle $2\theta=20$ to 110° using the Cu-K$\alpha$ characteristic X-rays, and the background is removed, to obtain respective peak intensities.

In the present invention, the superlattice of an $Fe_3Al$ ordered structure, the Fe oxide, and the Fe-based alloy having a bcc structure are measured using an X-ray diffraction apparatus, and confirmed according to identification using JCPDS (Joint Committee on Powder Diffraction Standards) cards from the obtained X-ray diffraction charts. The superlattice peak of an $Fe_3Al$ ordered structure can be identified as $Fe_3Al$ according to JCPDS card: 00-050-0955. The Fe oxide can be identified as $Fe_2O_3$ according to JCPDS card: 01-079-1741 from the diffraction peak. The Fe-based alloy having a bcc structure can be identified as bcc-Fe according to JCPDS card: 01-071-4409. Since the angle of the diffraction peak includes an error by fluctuation with respect to the data of the JCPDS card due to the solid solution of an element or the like, a case of a diffraction peak angle ($2\theta$) extremely close to each JCPDS card is defined as "vicinity". Specifically, the diffraction peak angle ($2\theta$) of $Fe_3Al$ is 26.3° to 26.9°; the diffraction peak angle ($2\theta$) of the Fe oxide is in the range of 32.9° to 33.5°; and the diffraction peak ($2\theta$) of the Fe-based alloy having a bcc structure is 44.2° to 44.8°.

In the present invention, the Fe-based alloy contains Al. The Fe-based alloy may further contain: Cr from the viewpoint of corrosion resistance; and Si in anticipation of improvement of magnetic properties, or the like. The Fe-based alloy may contain impurities mixed from a raw material or a process. The composition of the Fe-based alloy of the present invention is not particularly limited as long as it can constitute the magnetic core from which conditions such as the aforementioned peak intensity ratios (P1/P2, P3/P2) are obtained.

Preferably, the Fe-based alloy is represented by a composition formula: aFebAlcCrdSi, and in mass %, $a+b+c+d=100$, $13.8\leq b<16$, $0\leq c\leq 7$, and $0\leq d\leq 1$ are satisfied.

Al is an element for improving corrosion resistance or the like, and contributes to the formation of an oxide provided by a heat treatment to be described later. In addition, from the viewpoint of contributing to the reduction of crystal magnetic anisotropy, the content of Al in the Fe-based alloy is 13.8 mass % or more and 16 mass % or less. A too small content of Al causes an insufficient effect of reducing the crystal magnetic anisotropy, which does not provide an effect of improving the core loss.

In the binary composition of Fe and Al, $Fe_3Al$ is known to be produced in the vicinity of bal. Fe 25 at. % Al as a stoichiometric composition (bal. Fe 13.8 Al in mass %).

Therefore, it is preferable that the composition of the Fe-based alloy is in the range including the stoichiometric composition of $Fe_2Al$ in the binary composition of Fe and Al. Meanwhile, a too large content of Al may cause a decreased saturation magnetic flux density and insufficient magnetism, so that the amount of Al is preferably 15.5 mass % or less.

Cr is an optional element, and may be contained as an element for improving the corrosion resistance of the alloy in the Fe-based alloy. Cr is useful for bonding the Fe-based alloy particles via an oxide layer of the Fe-based alloy in a heat treatment to be described later. From this viewpoint, the content of Cr in the Fe-based alloy is preferably 0 mass % or more and 7 mass % or less. A too large amount of Al or Cr causes a decreased saturation magnetic flux density, and a hard alloy. Therefore, the total content of Cr and Al is more preferably 18.5 mass % or less. The content of Al is preferably more than that of Cr so as to facilitate the formation of an oxide layer having a high Al ratio.

The balance of the Fe-based alloy other than Al, and Cr if necessary, is mainly composed of Fe, but the Fe-based alloy can also contain other element as long as it exhibits an advantage such as improvement in formability or magnetic properties. However, it is preferable that, since a nonmagnetic element lowers a saturation magnetic flux density or the like, the content of the other element is 1.5 mass % or less in the total amount of 100 mass %.

For example, in a general refining step of an Fe-based alloy, Si is usually used as a deoxidizer to remove oxygen (O) which is an impurity. The added Si is separated as an oxide, and removed during the refining step, but a part thereof remains, and is contained in an amount of about 0.5 mass % or less as an unavoidable impurity in the alloy in many cases. A highly-pure raw material can be used and subjected to vacuum melting or the like to refine the highly-pure raw material, but the highly-pure raw material causes poor mass productivity, which is not preferable from the viewpoint of cost. If the particles contain a large amount of Si, the particles become hard. Meanwhile, when an amount of Si is contained, an initial permeability can be increased, and a core loss can be reduced in some cases as compared with the case where Si is not contained. In the present invention, Si of 1 mass % or less may be contained. The range of the amount of Si is set in not only a case where Si is present as an inevitable impurity (typically, 0.5 mass % or less) but also a case where a small amount of Si is added.

The Fe-based alloy may contain, for example, Mn≤1 mass %, C≤0.05 mass %, Ni≤0.5 mass %, N≤0.1 mass %, P≤0.02 mass %, S≤0.02 mass % as inevitable impurities or the like. The amount of O contained in the Fe-based alloy is preferably as small as possible, and more preferably 0.5 mass % or less. All of the composition amounts are also values when the total amount of Fe, Al, Cr, and Si is 100 mass %.

The average particle diameter of the Fe-based alloy particles (here, a median diameter d50 in cumulative particle size distribution is used) is not particularly limited, but by decreasing the average particle diameter, the strength and high frequency characteristics of the magnetic core are improved. For example, in applications requiring the high frequency characteristics, the Fe-based alloy particles having an average particle size of 20 μm or less can be suitably used. The median diameter d50 is more preferably 18 μm or less, and still more preferably 16 μm or less. Meanwhile, when the average particle size is small, the permeability is low, and the specific surface area is large, which facilitates oxidation, so that the median diameter d50 is preferably 5 μm or more. Coarse particles are more preferably removed from the Fe-based alloy particles by using a sieve or the like. In this case, it is preferable to use at least alloy particles of less than 32 μm (that is, passing through a sieve having an opening of 32 μm).

A method of manufacturing a magnetic core of the present embodiment includes the steps of: molding an Fe-based alloy particle powder to obtain a green compact (green compact forming step); and heat treating the green compact to form the oxide layer (heat treating step).

The form of the Fe-based alloy particles is not particularly limited, but from the viewpoint of fluidity or the like, it is preferable to use a granular powder typified by an atomized powder as a raw material powder. An atomization method such as gas atomization or water atomization is suitable for preparing an alloy powder which has high malleability and ductility and is hard to be pulverized. The atomization method is also suitable for obtaining a substantially spherical soft magnetic alloy powder.

In the green compact forming step, a binder is preferably added to the Fe-based alloy powder in order to bind Fe-based alloy particles to each other when the particles are pressed, and to impart a strength to withstand handling after molding to the green compact. The kind of the binder is not particularly limited, but various organic binders such as polyethylene, polyvinyl alcohol, and an acrylic resin can be used, for example. The organic binder is thermally decomposed by a heat treatment after molding. Therefore, an inorganic binder such as a silicone resin, which solidifies and remains even after the heat treatment or binds powders as Si oxides, may be used together.

The amount of the binder to be added may be such that the binder can be sufficiently spread between the Fe-based alloy particles to ensure a sufficient green compact strength. Meanwhile, the excessive amount of the binder decreases the density and the strength. From such a viewpoint, the amount of the binder to be added is preferably 0.5 to 3.0 parts by weight based on 100 parts by weight of the Fe-based alloy having an average particle diameter of 10 μm, for example. However, in the method of manufacturing a magnetic core according to the present embodiment, the oxide layer formed in the heat treatment step exerts the action of bonding the Fe-based alloy particles to each other, whereby the use of the inorganic binder is preferably omitted to simplify the step.

The method of mixing the Fe-based alloy particles and the binder is not particularly limited, and conventionally known mixing methods and mixers can be used. In the mixed state of the binder, the mixed powder is an agglomerated powder having a broad particle size distribution due to its binding effect. By causing the mixed powder to pass through a sieve using, for example, a vibration sieve or the like, a granulated powder having a desired secondary particle size suitable for molding can be obtained. A lubricant such as stearic acid or a stearic acid salt is preferably added in order to reduce friction between the powder and a mold during pressing. The amount of the lubricant to be added is preferably 0.1 to 2.0 parts by weight based on 100 parts by weight of the Fe-based alloy particles. The lubricant can also be applied to the mold.

Next, the resultant mixed powder is pressed to obtain a green compact. The mixed powder obtained by the above procedure is suitably granulated as described above, and is subjected to a pressing step. The granulated mixed powder is pressed to a predetermined shape such as a toroidal shape or a rectangular parallelepiped shape using a pressing mold. The pressing may be room temperature molding or warm molding performed during heating such that a binder does not disappear. The molding pressure during pressing is preferably 1.0 GPa or less. The molding at a low pressure allows to realize a magnetic core having high magnetic properties and a high strength while suppressing the breakage or the like of the mold. The preparation and molding methods of the mixed powder are not limited to the above pressing.

Next, a heat treatment step of heat-treating the green compact obtained through the green compact forming step will be described. In order to form the oxide layer between the Fe-based alloy particles, the green compact is subjected to a heat treatment (high-temperature oxidation) to obtain a heat treated product. Such a heat treatment allows to alleviate stress distortion introduced by molding or the like. This oxide layer is obtained by reacting the Fe-based alloy particles with oxygen (O) by a heat treatment to grow the Fe-based alloy particles, and is formed by an oxidation reaction exceeding the natural oxidation of the Fe-based alloy. The oxide layer covers the surface of the Fe-based alloy particles, and furthermore voids between the particles are filled with the oxide layer. The heat treatment can be performed in an atmosphere in which oxygen is present, such as in the air or in a mixed gas of oxygen and an inert gas. The heat treatment can also be performed in an atmosphere in which water vapor is present, such as in a mixed gas of water vapor and an inert gas. Among them, the heat treatment in the air is simple, which is preferable. In this oxidation reaction, in addition to Fe, Al having a high affinity for O is also released, to form an oxide between the Fe-based alloy particles. When Cr or Si is contained in the Fe-based alloy, Cr or Si is also present between the Fe-based alloy particles, but the affinity of Cr or Si with O is smaller than that of Al, whereby the amount of Cr or Si is likely to be relatively smaller than that of Al.

The compound having an $Fe_3Al$ ordered structure is also formed in the heat treatment. Although a place where the compound is formed cannot be specified, the compound is presumed to be preferentially formed in the internal part of the Fe-based alloy particles.

The heat treatment in the present step may be performed at a temperature at which the oxide layer or the like is formed, but the heat treatment is preferably performed at a temperature at which the Fe-based alloy particles are not significantly sintered. By the necking of the alloys due to the significant sintering, a part of the oxide layer is surrounded by the alloy particles to be isolated in an island form. For this reason, the function as an insulating layer separating the particles is deteriorated. Since the amount of the oxide of Fe and the compound having an $Fe_3Al$ ordered structure is influenced by the heat treatment temperature, the specific heat treatment temperature is preferably in the range of 650 to 850° C. A holding time in the above temperature range is appropriately set depending on the size of the magnetic core, the treated amount, the allowable range of characteristic variation or the like, and is set to 0.5 to 3 hours, for example.

The space factor of the magnetic core may be 80% or more. If the space factor is less than 80%, a desired initial permeability may not be obtained.

Figure 2A:
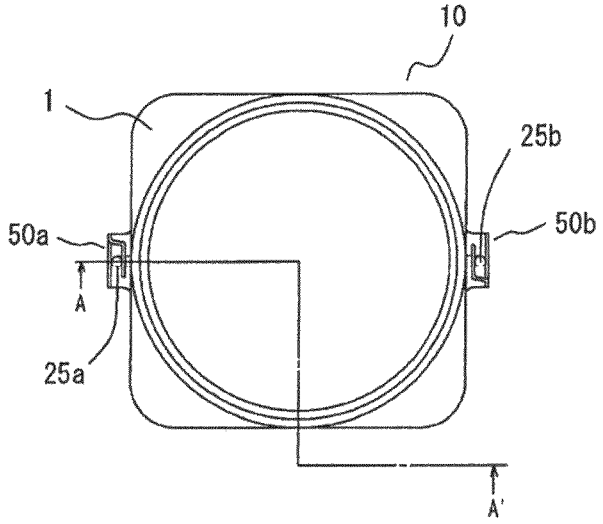
FIG. 2A is a plan view schematically showing a coil component according to an embodiment of the present invention.
Figure 2B:
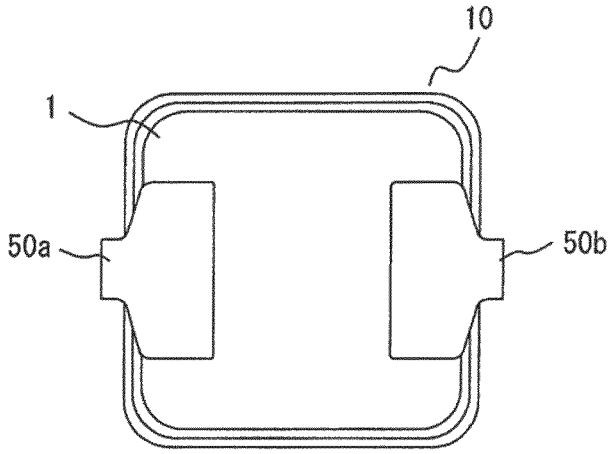
FIG. 2B is a bottom view schematically showing a coil component according to an embodiment of the present invention.
Figure 2C:
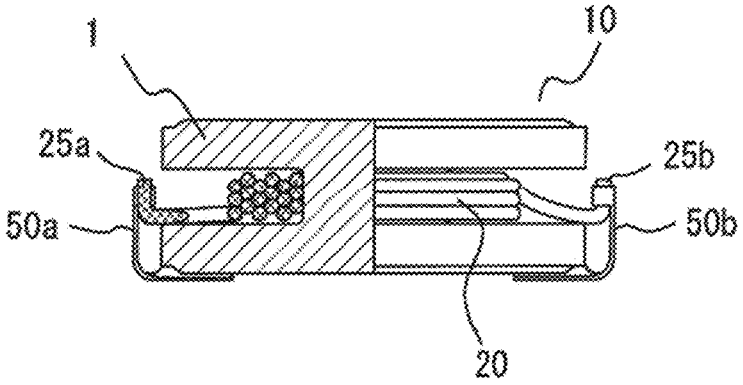
FIG. 2C is a partial cross-sectional view taken along line A-A' in FIG. 2A.

FIG. 2A is a plan view schematically showing the coil component of the present embodiment. FIG. 2B is a bottom view thereof. FIG. 2C is a partial cross-sectional view taken along line A-A' in FIG. 2A. A coil component 10 includes a magnetic core 1 and a coil 20 wound around a conductive wire winding portion 5 of the magnetic core 1. On a mounting surface of a flange portion 3*b* of the magnetic core 1, each of metal terminals 50*a*, 50*b* is provided on each of edge portions symmetrically located to the center of gravity interposed therebetween, and a free end portion of one of the metal terminals 50*a*, 50*b* protruding from the mounting surface rises at right angles to the height direction of the magnetic core 1. The rising free end portions of the metal terminals 50*a*, 50*b* and end portions 25*a*, 25*b* of the coil are respectively joined to each other to establish electrical connection therebetween. Such a coil component having the magnetic core and the coil is used as, for example, a choke, an inductor, a reactor, and a transformer, or the like.

The magnetic core may be manufactured in the form of a single magnetic core obtained by pressing only a soft magnetic alloy powder mixed with a binder or the like as described above, or may be manufactured in a form in which a coil is disposed in the magnetic core. The latter configuration is not particularly limited, and can be manufactured in the form of a magnetic core having a coil-enclosed structure using a method of integrally pressing a soft magnetic alloy powder and a coil, or a lamination process such as a sheet lamination method or a printing method, for example.

EXAMPLES

Hereinafter, preferred examples of the present invention will be demonstratively described in detail. In the description, an Fe—Al—Cr-based alloy is used as an Fe-based alloy. However, materials and blend amounts or the like described in Examples are not intended to limit the scope of the present invention only to those in the description unless the materials and the blend amounts or the like are particularly limitedly described.

(1) Preparation of Raw Material Powder

A raw material powder of an Fe-based alloy was prepared by an atomizing method. The composition analysis results are shown in Table 1.

TABLE 1

| Raw material | Component (mass %) | | | | | | | | |
|---|---|---|---|---|---|---|---|---|---|
| powder | Fe | Al | Cr | Si | O | C | P | S | N |
| A | bal | 2.01 | 3.90 | 0.2 | 0.2 | 0.004 | Unmeasured | Unmeasured | 0.038 |
| B | bal | 5.05 | 4.04 | 0.2 | 0.19 | 0.007 | 0.007 | 0.002 | 0.010 |
| D | bal | 11.62 | 3.92 | 0.2 | 0.45 | 0.012 | 0.010 | 0.004 | 0.001 |
| C | bal | 14.38 | 4.12 | 0.2 | 0.2 | 0.01 | 0.015 | 0.001 | 0.004 |

For each analytical value, Al is analyzed by an ICP emission spectrometry method; Cr, a capacitance method; Si and P, an absorptiometric method; C and S, a combustion-infrared adsorption method, O, an inert gas melting-infrared absorption method; and N, an inert gas melting-thermal conductivity method. The contents of O, C, P, S and N were confirmed, and were less than 0.05 mass % based on 100 mass % of the total amount of Fe, Al, Cr and Si.

The average particle diameter (median diameter d50) of the raw material powder was obtained by a laser diffraction scattering type particle size distribution measuring apparatus (LA-920, manufactured by Horiba, Ltd.). A BET specific surface area was obtained according to a gas adsorption method using a specific surface area measuring apparatus (Macsorb, manufactured by Mountech). The saturation magnetization Ms and coercive force He of each of the raw material powders were obtained by a VSM magnetic property measuring apparatus (VSM-5-20, manufactured by Toei Kogyo Co., Ltd.). In measurement, a capsule was filled with the raw material powder, and a magnetic field (10 kOe) was applied thereto. The saturation magnetic flux density Bs was calculated from the saturation magnetization Ms according to the following formula.

$$\text{Saturation Magnetic Flux Density } Bs(T)=4\pi\times Ms\times\rho_t\times 10^{-4}$$

($\rho_t$: true density of Fe-based alloy)

The true density $\rho_t$ of the Fe-based alloy was obtained by measuring an apparent density from each of ingots of alloys providing raw material powders A to D according to a liquid weighing method. Specifically, ingots cast with Fe-based alloy compositions of the raw material powders A to D and having an outer diameter of 30 mm and a height of 200 mm were cut to have a height of 5 mm by a cutting machine, to obtain samples, and the samples were evaluated. The measurement results are shown in Table 2.

TABLE 2

| Raw material powder | Average particle diameter d50 (μm) | Specific surface area ($m^2$/g) | Hc (A/m) | Ms (emu/g) | Bs (T) |
|---|---|---|---|---|---|
| A | 12.3 | 0.20 | 1010 | 190 | 1.8 |
| B | 12.6 | 0.25 | 941 | 180 | 1.7 |
| D | 11.2 | 0.36 | 951 | 149 | 1.3 |
| C | 11.7 | 0.35 | 632 | 120 | 1.0 |

(2) Preparation of Magnetic Core

A magnetic core was prepared as follows. Into each of the A to D raw material powders, PVA (Poval PVA-205, manufactured by KURARAY CO., LTD., solid content: 10%) as a binder and ion-exchanged water as a solvent were charged, followed by stirring and mixing to prepare a slurry. The concentration of the slurry was 80 mass %. The amount of the binder was 0.75 parts by weight based on 100 parts by weight of the raw material powder. The resultant mixed powder was spray dried by a spray drier, and the dried mixed powder was caused to pass through a sieve to obtain a granulated powder. To this granulated powder, zinc stearate was added at a ratio of 0.4 parts by weight based on 100 parts by weight of the raw material powder, followed by mixing.

The resultant granulated powder was pressed at room temperature by using a press machine to obtain a toroidal (circular ring)-shaped green compact and a disc-shaped green compact as a sample for X-ray diffraction intensity measurement. This green compact was heated at 250° C./h in the air, and subjected to a heat treatment held at each heat treatment temperature of 670° C., 720° C., 730° C., 770° C., 820° C. and 870° C. for 45 minutes to obtain a magnetic core. The magnetic core had an outside size including an outer diameter of 13.4 mm, an inner diameter of 7.7 mm, and a height of 2.0 mm. As the magnetic core for X-ray diffraction intensity measurement, a sample having an outer diameter of 13.5 mm and a height of 2.0 mm was used.

(3) Evaluation Method and Results

Figure 3:
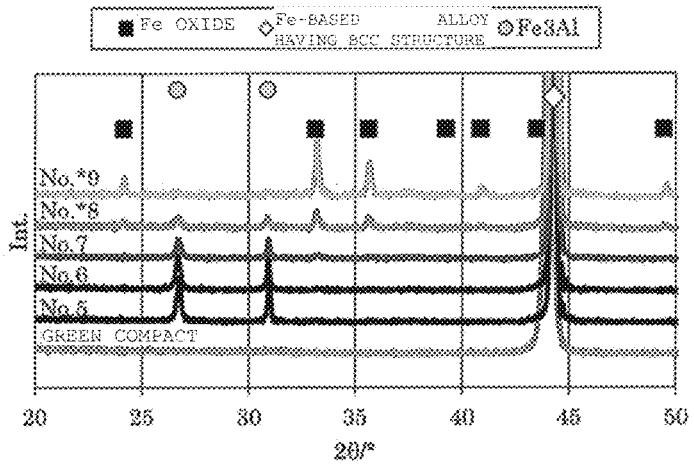
FIG. 3 is a view for illustrating X-ray diffraction spectra of Samples No. 5 to No. *9 prepared in Examples.
Figure 4:
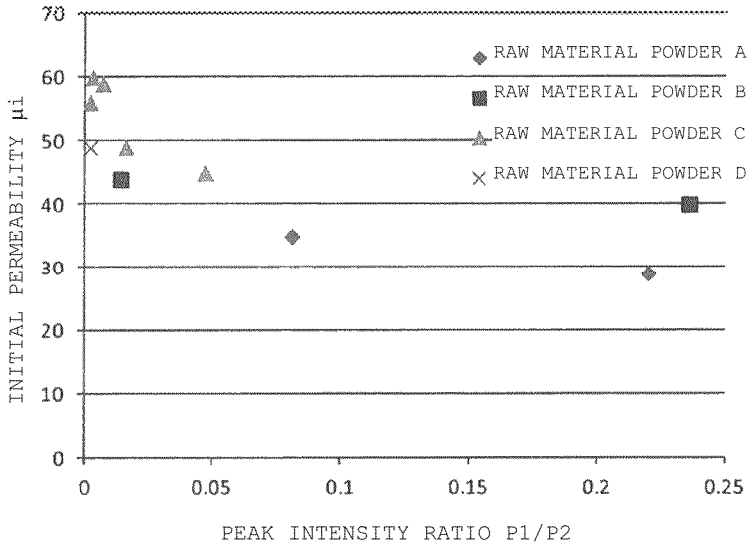
FIG. 4 is a diagram showing a relationship between a peak intensity ratio (P1/P2) and an initial permeability μi.
Figure 5:
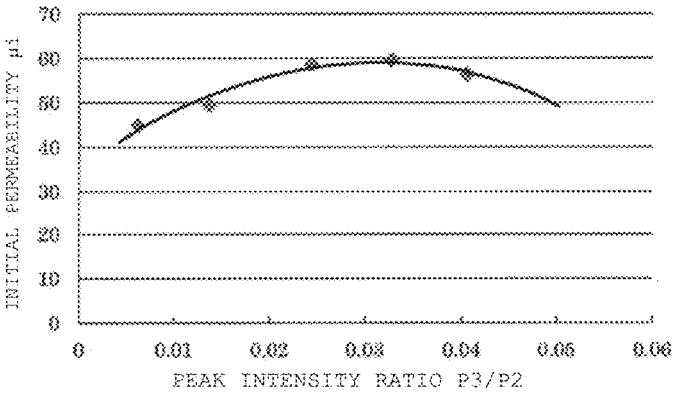
FIG. 5 is a diagram showing a relationship between a peak intensity ratio (P3/P2) and an initial permeability μi.
Figure 6A:
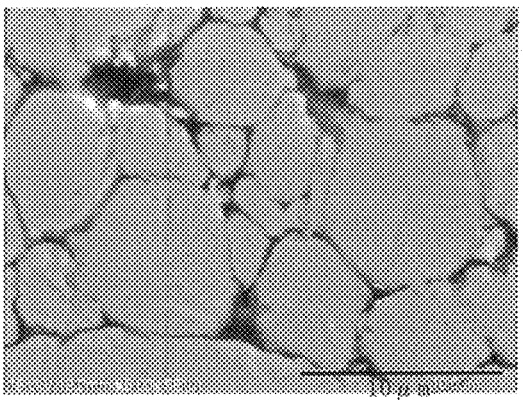
FIG. 6A is an SEM image of a cross section of a magnetic core of Sample No. 6 prepared in Examples.
Figure 6B:
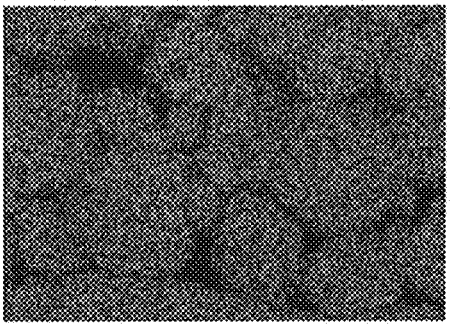
FIG. 6B is an SEM image of a cross section of a magnetic core of Sample No. 6 prepared in Examples.
Figure 6C:
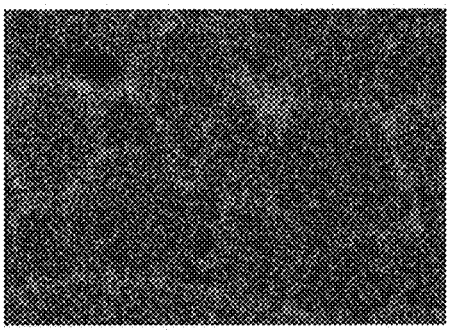
FIG. 6C is an SEM image of a cross section of a magnetic core of Sample No. 6 prepared in Examples.
Figure 6D:
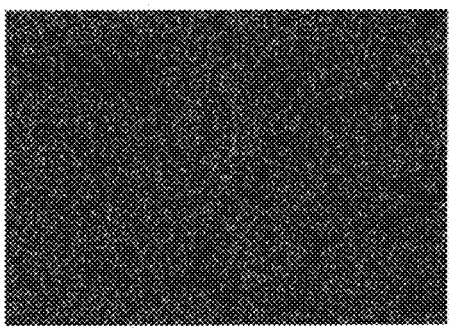
FIG. 6D is an SEM image of a cross section of a magnetic core of Sample No. 6 prepared in Examples.
Figure 6E:
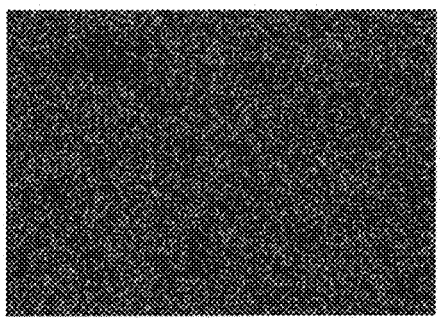
FIG. 6E is an SEM image of a cross section of a magnetic core of Sample No. 6 prepared in Examples.

Each of the magnetic cores prepared by the above steps was subjected to the following evaluations. The evaluation results are shown in Table 3. In Table 3, samples of Comparative Examples are distinguished by imparting * to Sample No. A portion represented by "-" in the diffraction peak intensity column in Table means that, in the X-ray diffraction spectrum, the peak intensity of the diffraction peak is equal to or less than the noise level, and the intensity of the diffraction peak is equal to the noise level forming the base line (X-ray scattering obtained in an unavoidable manner), or less than the noise level, which is difficult to detect the diffraction peak, and the diffraction peak cannot be confirmed. FIG. 3 shows the X-ray diffraction intensities of Samples No. 5 to No. *9. FIG. 4 is a diagram showing a relationship between a peak intensity ratio (P1/P2) and an initial permeability μi, and FIG. 5 is a diagram showing a relationship between a peak intensity ratio (P3/P2) and an initial permeability μi. FIG. 6A shows an SEM image of the cross section of the magnetic core of Sample No. 6, and FIGS. 6B to 6F show composition mapping images of the cross section of the magnetic core of Sample No. 6 provided by EDX (Energy Dispersive X-ray Spectroscopy).

A. Space Factor Pf (Relative Density)

A density ds (kg/$m^3$) of the annular magnetic core was calculated from the size and mass of the annular magnetic core according to a volume weight method. The space factor (relative density) [%] of the magnetic core was calculated by dividing the density ds by the true density of each of the Fe-based alloys. The true density here is also the same as the true density used for calculating the saturation magnetic flux density Bs.

B. Specific Resistance ρv

A disc-shaped magnetic core is used as an object to be measured. After a conductive adhesive is applied to each of two opposing planes of the object to be measured, dried and solidified, the object to be measured is set between electrodes. A DC voltage of 100 V is applied by using an electrical resistance measuring apparatus (8340A, manufactured by ADC Co., Ltd.) to measure a resistance value R (Ω). The plane area A ($m^2$) and thickness t (m) of the object to be measured were measured, and specific resistance ρ (Ωm) was calculated according to the following formula.

$$\text{Specific Resistance } \rho v(\Omega n)=R\times(A/t)$$

The magnetic core had a representative size including an outer diameter of 13.5 mm and a height of 2 mm.

C. Radial Crushing Strength or

Based on JIS Z2507, the circular magnetic core was used as an object to be measured. The object to be measured was disposed between platens of a tensile/compressive tester (Autograph AG-1, manufactured by Shimadzu Corporation) such that a load direction was a radial direction. A load was applied in the radial direction of the circular magnetic core to measure a maximum load P (N) at the time of breaking, and the radial crushing strength or (MPa) was obtained from the following formula.

$$\text{Radial Crushing Strength or (MPa)}=P\times(D-d)/(I\times d^2)$$

[D: Outer Diameter of Magnetic Core (mm), d: Thickness of Magnetic Core [½ of Difference between Inner and Outer Diameters (mm), I: Height of Magnetic Core (mm)]

D. Core Loss Pcv

The circular magnetic core was used as an object to be measured. Each of a primary side winding wire and a secondary side winding wire was wound by 15 turns. The core loss Pcv (kW/$m^3$) was measured at room temperature on a condition of a maximum magnetic flux density of 30 mT and a frequency of 300 kHz by using a B-H Analyzer SY-8232, manufactured by Iwatsu Test Instruments Corporation.

an applied voltage of 40 kV, a current of 100 mA, a divergence slit of 1°, a scattering slit of 1°, a receiving slit of 0.3 mm, continuous scanning, a scanning speed of 2°/min, a scanning step of 0.02°, and a scanning range of 20 to 110°.

TABLE 3

| Sample No. | Raw material powder | Heat treatment temperature (° C.) | Space factor (%) | Diffraction peak intensity P1 (104) | P2 (110) | P3 (111) | Peak intensity ratio P1/P2 | P3/P2 | Core loss Pcv (30 mT, 300 kHz) (kW/m$^2$) | μl 100 kHz | μΔ 10 kA/m | pv (at 100 V) (kΩm) | Radial crushing strength (MPa) |
|---|---|---|---|---|---|---|---|---|---|---|---|---|---|
| *1 | A | 720 | 83.7 | 252 | 3107 | — | 0.081 | — | 775 | 35 | 23 | Insulation breakdown | 163 |
| *2 | | 820 | 85.1 | 521 | 2364 | — | 0.220 | — | 870 | 29 | 21 | Insulation breakdown | 281 |
| *3 | B | 720 | 83.6 | 49 | 3419 | — | 0.014 | — | 558 | 44 | 24 | 44.64 | 158 |
| *4 | | 870 | 86.7 | 530 | 2244 | — | 0.236 | — | 577 | 40 | 22 | insulation breakdown | 365 |
| *10 | D | 730 | 86.1 | 7 | 3280 | — | 0.002 | — | 398 | 49 | 21 | 18.61 | 166 |
| 5 | C | 670 | 83.0 | 9 | 3481 | 141 | 0.002 | 0.041 | 651 | 56 | 17 | 13.97 | 100 |
| 6 | | 720 | 83.7 | 11 | 3767 | 123 | 0.003 | 0.033 | 602 | 60 | 17 | 13.01 | 140 |
| 7 | | 770 | 85.4 | 23 | 3367 | 82 | 0.007 | 0.024 | 595 | 59 | 18 | 13.23 | 197 |
| *8 | | 820 | 86.8 | 56 | 3585 | 49 | 0.016 | 0.014 | 656 | 49 | 19 | 1.24 | 228 |
| *9 | | 870 | 87.3 | 159 | 3397 | 21 | 0.047 | 0.006 | 1454 | 45 | 20 | Insulation breakdown | 319 |

E. Initial Permeability μi

The circular magnetic core was used as an object to be measured. A conductive wire was wound by 30 turns, and the initial permeability was obtained according to the following formula from inductance measured at a frequency of 100 kHz at room temperature by an LCR meter (4284A, manufactured by Agilent Technologies Co., Ltd.).

$$\text{Initial Permeability } \mu i=(le\times L)/(\mu_0\times Ae\times N^2)$$

(le: Magnetic Path Length, L: Inductance of Sample (H), $\mu_0$: Vacuum Permeability=$4\pi\times10^{-7}$ (H/m), Ae: Cross Section of Magnetic Core, N: Winding Number of Coil)

F. Incremental Permeability μΔ

The circular magnetic core was used as an object to be measured. A conductive wire was wound by 30 turns to form a coil component. Inductance L was measured at a frequency of 100 kHz at room temperature by an LCR meter (4284A, manufactured by Agilent Technologies Co., Ltd.) in a state where a direct current magnetic field of up to 10 kA/m was applied by a direct current applying apparatus (42841A, manufactured by Hewlett Packard). From the obtained inductance, the incremental permeability μΔ was obtained as in the initial permeability μi.

G. Structure Observation and Composition Distribution

A toroidal-shaped magnetic core was cut, and the cut surface was observed by a scanning electron microscope (SEM/EDX: Scanning Electron Microscope/Energy Dispersive X-ray Spectroscopy) to perform element mapping (magnification: 2000 times).

H. X-Ray Diffraction Intensity Measurement

From a diffraction spectrum according to an X-ray diffraction method using an X-ray diffraction apparatus (Rigaku RINT-2000, manufactured by Rigaku Corporation), a peak intensity P1 of a diffraction peak of an Fe oxide having a corundum structure appearing in the vicinity of 2θ=33.2°, a peak intensity P2 of a diffraction peak of an Fe-based alloy having a bcc structure appearing in the vicinity of 2θ=44.7°, and a peak intensity P3 of a superlattice peak of an $Fe_3Al$ ordered structure appearing in the vicinity of 2θ=26.6° were obtained, to calculate peak intensity ratios (P1/P2, P3/P2). The condition for the X-ray diffraction intensity measurement included X-ray of Cu-Kα, an applied voltage of 40 kV, a current of 100 mA, a divergence slit of 1°, a scattering slit of 1°, a receiving slit of 0.3 mm, continuous scanning, a scanning speed of 2°/min, a scanning step of 0.02°, and a scanning range of 20 to 110°.

In Samples No. 5 to No. 7 as Examples, the peak intensity ratio (P1/P2) of the peak intensity P1 of the diffraction peak of the Fe oxide having a corundum structure appearing in the vicinity of 2θ=33.2° to the peak intensity P2 of the diffraction peak of the Fe-based alloy having a bcc structure appearing in the vicinity of 2θ=44.7° was 0.015 or less, and in the X-ray diffraction spectrum, the peak intensity ratio (P3/P2) of the peak intensity P3 of the superlattice peak of an $Fe_3Al$ ordered structure appearing in the vicinity of 2θ=26.6° to the peak intensity P2 was 0.015 or more and 0.050 or less, whereby a magnetic core having a higher initial permeability than that of Sample of each of Comparative Examples was obtained. It was found that the above configuration according to Examples is extremely advantageous for obtaining excellent magnetic properties. The core loss, the specific resistance ρv, and the radial crushing strength were same as or greater than those of each of Samples of Comparative Examples.

The X-ray diffraction spectra of Samples No. 5 to No. *9 using the raw material powder C shown in FIG. 3 also show the X-ray diffraction spectrum of the green compact (not subjected to heat treatment). As shown therein, the Fe oxide and the compound derived from $Fe_3Al$ are formed by the heat treatment, and the peak intensity of the diffraction peak changes according to the heat treatment temperature. That is, by adjusting the heat treatment temperature, the target peak intensity ratios (P1/P2, P3/P2) can be obtained to efficiently prepare a magnetic core having excellent magnetic properties.

As shown in FIG. 4, the initial permeability μi tends to increase as the peak intensity ratio (P1/P2) of the peak intensity P1 to the peak intensity P2 decreases. As shown in FIG. 5, it is found that the initial permeability μi changes in a parabolic fashion with respect to the peak intensity ratio (P3/P2) of the peak intensity P3 to the peak intensity P2 in the X-ray diffraction spectrum, and has an extreme value.

FIG. 6A shows the evaluation results of cross section observation using a scanning electron microscope (SEM) for the magnetic core of Sample No. 6, and FIGS. 6B to 6F show the evaluation results of the distributions of constituent elements by EDX. FIGS. 6B to 6F are mappings respectively showing the distributions of Fe (iron), Al (aluminum), Cr (chromium), Si (silicon) and O (oxygen). A brighter color tone (looking white in the figures) represents a more target element.

Figure 6F:
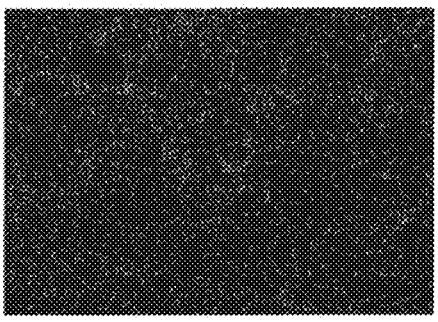
FIG. 6F is an SEM image of a cross section of a magnetic core of Sample No. 6 prepared in Examples.

From FIG. 6F, it is found that much oxygens are present between the Fe-based alloy particles to form an oxide, and the Fe-based alloy particles are bonded via the oxide. From FIG. 6C, the concentration of Al between particles (grain boundary) including the surface of alloy particles was confirmed to be remarkably higher than that of other nonferrous metal.

DESCRIPTION OF REFERENCE SIGNS

1 magnetic core

3*a*, 3*b* flange portion

5 conductive wire winding portion

10 coil component

20 coil

25*a*, 25*b* end portion of coil

50*a*, 50*b* metal terminal

The invention claimed is:

1. A magnetic core comprising Fe-based alloy particles containing Al, wherein:

the Fe-based alloy particles are bound via an oxide derived from an Fe-based alloy;

in an X-ray diffraction spectrum of the magnetic core measured using Cu-Kα characteristic X-rays, a peak intensity ratio (P1/P2) of a peak intensity P1 of a diffraction peak of an Fe oxide having a corundum structure appearing in a vicinity of $2\theta=33.2°$ to a peak intensity P2 of a diffraction peak of the Fe-based alloy having a bcc structure appearing in a vicinity of $2\theta=44.7°$ is 0.015 or less; and in the X-ray diffraction spectrum, a peak intensity ratio (P3/P2) of a peak intensity P3 of a superlattice peak of an $Fe_3Al$ ordered structure appearing in a vicinity of $2\theta=26.6°$ to the peak intensity P2 is 0.015 or more and 0.050 or less.

2. The magnetic core according to claim 1, wherein the magnetic core has an initial permeability μi of 55 or more.

3. The magnetic core according to claim 1, wherein:

the Fe-based alloy is represented by a composition formula: aFebAlcCrdSi; and in mass %, $a+b+c+d=100$, $13.8\leq b\leq 16$, $0\leq c\leq 7$, and $0\leq d\leq 1$ are satisfied.

4. A coil component comprising the magnetic core according to claim 1 and a coil.

* * * * *